United States Patent [19]

Soong

[11] Patent Number: 4,988,101

[45] Date of Patent: Jan. 29, 1991

[54] SHOCK ABSORBING STRING POST FOR SPORTS RACKETS

[76] Inventor: Tsai C. Soong, 1839 Jackson Rd., Penfield, N.Y. 14625

[21] Appl. No.: 402,549

[22] Filed: Sep. 5, 1989

[51] Int. Cl.[5] ..... A63B 51/10

[52] U.S. Cl. ..... 273/73 D; 273/73 G

[58] Field of Search ..... 273/73 R, 73 C, 73 D, 273/73 E, 73 G, 73 H

[56] References Cited

U.S. PATENT DOCUMENTS

| | | | |
|---|---|---|---|
| 1,663,039 | 3/1928 | Craven | 273/73 E |
| 1,790,156 | 1/1931 | Kleinman | 273/73 E |
| 2,165,701 | 7/1939 | Goerke | 273/73 E |
| 2,206,548 | 7/1940 | Goerke | 273/73 E |
| 4,026,553 | 5/1977 | Vendramini | 273/73 E |
| 4,099,717 | 7/1978 | Sacks | 273/73 E |
| 4,322,076 | 3/1982 | Bertram et al. | 273/73 G X |
| 4,333,650 | 6/1982 | Soong | 273/73 G X |
| 4,437,662 | 3/1984 | Soong | 273/73 G X |

*Primary Examiner*—Edward M. Coven
*Assistant Examiner*—William E. Stoll
*Attorney, Agent, or Firm*—Bernard A. Chiama

[57] ABSTRACT

A damping device for application to longitudinal network strings used in sports rackets having a frame comprising a head, side portions and a throat section supporting the side portions. At least some of the longitudinal strings are directed toward and around a string post or anchoring member mounted within the throat section. A damping device is positioned between the string post and the strings where the latter are turned around the post. In another embodiment, two or more string posts are arranged whereby some of the outer strings may be applied to one of the posts, and some of the inner longitudinal strings may be applied to one or more of the other posts.

8 Claims, 2 Drawing Sheets

SHOCK ABSORBING STRING POST FOR SPORTS RACKETS

Background of Invention

Suppression of shock and vibration in a sports racket has been a critical design goal that has eluded experts in the field. The prior art is very extensive in descriptions of arrangements designed to reduce vibration in a racket frame by means of using foam material, composite material, in sandwich form or in homogeneous types, by means of vibration dampers near the top of the frame or near the throat either in separate attachments or as an integral part of the frame, attached on strings or on frames, etc. In those arrangements employing vibration dampers attached on strings, most are installed locally near the throat or the head which can affect only a few nearby strings. However, since disturbance caused by the impact of a ball spreads far and wide in the whole string network, damping of a few strings cannot be very effective.

The present invention was devised to overcome the problems discussed above and considers that the longitudinal string group, which transmits the major portion of the shock load to the hand, may be channeled toward the handle in a converging manner such that a localized shock absorbing device, installed at the converging point of these strings, may damp a large number of the longitudinal strings effectively to achieve the purpose of shock absorbing of the frame to a degree that was not possible before. The success of this arrangement depends upon two aspects of the design: (1) a large number of the longitudinal strings should be led toward that localized damping device; (2) the damping device has to be simple, easily installed, replaceable and effective.

The invention is particularly applicable to a sports racket which employs a network consisting of longitudinal strings and cross strings, the majority of longitudinal strings in the central portion of the string network, along the longitudinal axis of the racket, being directed in a fanout arrangement from the center of the network narrowing toward the handle, where at least a third of the longitudinal strings are anchored in the shank region between the throat and the handle. These longitudinal strings may be anchored either at a single string post or several such string posts in the shank region.

These central longitudinal strings are wound around a half-circle shaped string seat which rests upon a shock absorbing cushion arranged on a string post. The shock absorbing cushion transmits the reduced shock to the string post arranged as a rigid integral part of the frame.

Preferred Embodiment of the Invention

Figure 1:
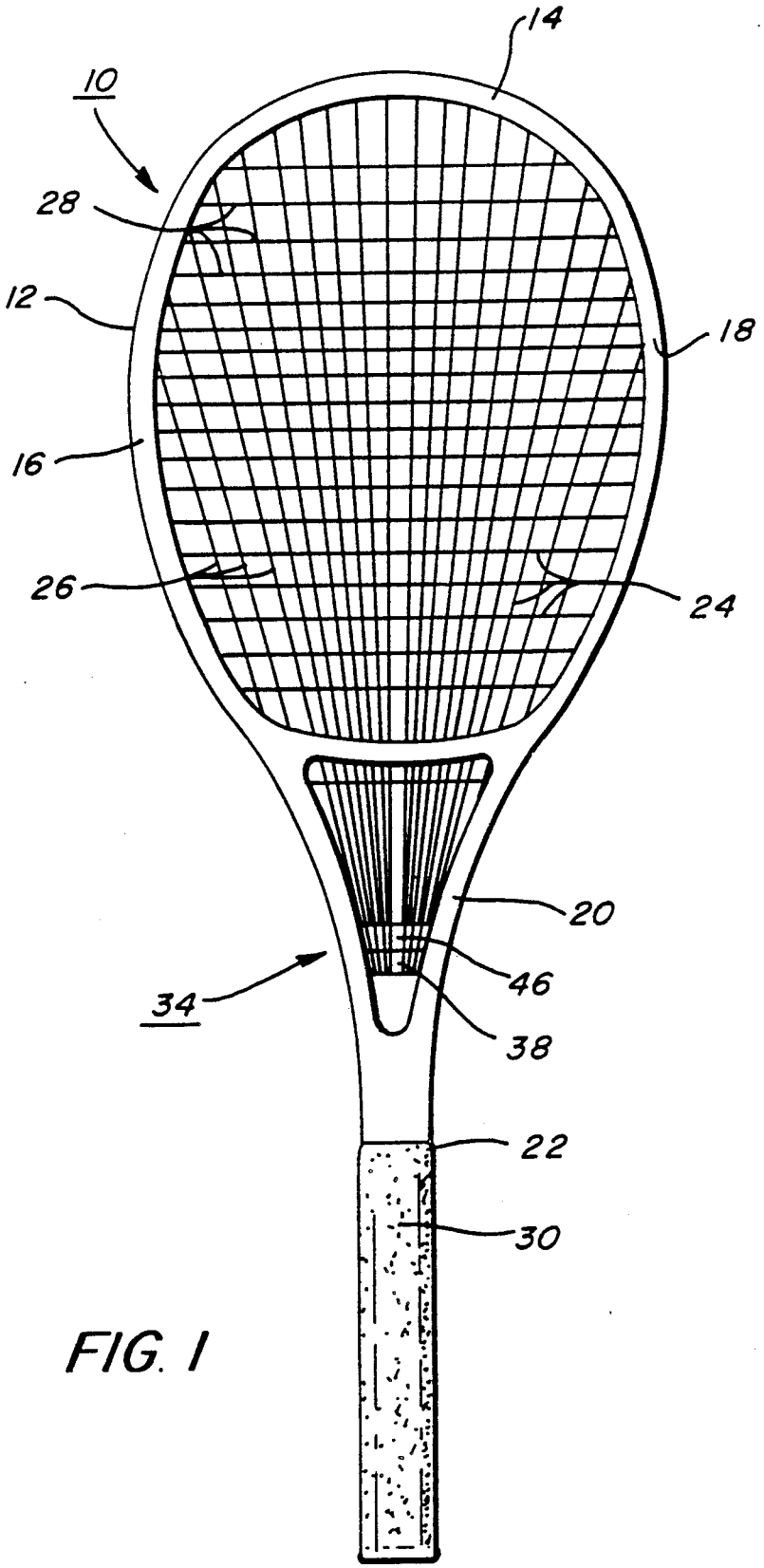
FIG. 1 is a plan view of a tennis racket to which the present invention is applied.

Referring to the drawings, there is shown in FIG. 1 a sports racket , for example, a tennis racket, indicated generally by the reference numeral 10, embodying the present invention. While a tennis racket is illustrated, it will be understood that the present invention is equally applicable to rackets used in badminton, squash and racquet ball.

The racket 10, as in conventional tennis rackets, includes a frame 12; having a top section or head 14; side sections 16, 18; a throat 20 supporting the head and a handle 22. Within the top section or head 14, between the side members 16, 18 is a string network 24 comprising longitudinal strings 26 and parallel cross or transverse strings 28. As in conventional rackets, the frame 12 is formed with openings to receive the strings.

The present invention is particularly applicable to sports rackets wherein the longitudinal strings 26 are strung upon the frame 12, having a portion of the central strings with axes converging approximately to a point 30 located in the handle 22, as shown in FIG. 1, preferably within the palm of a player's hand when gripping the handle during play. The transverse strings 28, on the other hand, are arranged with their axes parallel. It is also significant to the present invention that the tension placed upon the string network 24 during stringing of the racket 10 is such that the tension on the longitudinal strings is greater than that for the transverse strings.

With a longitudinal string network, as illustrated, having a curved top section and narrowing down to the throat section, the network is triangular shaped, elastically supported at its top side and supported along a large portion of its two lateral side sections 16, 18, with the rest almost free until it reaches an end point in the form of an anchoring string seating post member generally indicated by the reference numeral 34. Optimum results are achieved by having the transverse strings 28 at the relatively low tension and the longitudinal strings at a higher tension, about 50% to 90% higher in tension than the transverse string tension.

With this arrangement, the transverse string system will let the ball sink deeper into the network and allow the longitudinal strings 26 to provide the predominating force to resist the impact of a ball. In view of this role played by the converging longitudinal strings 26, the present invention is directed to an arrangement wherein a vibration and shock damping means for the longitudinal strings is applied to the anchoring member 34 and out of the immediate vicinity of the string network 24. The damped end of the string system will damp a shock load because all three sides of the network will allow the lower end of the network to move and be damped.

Figure 2:
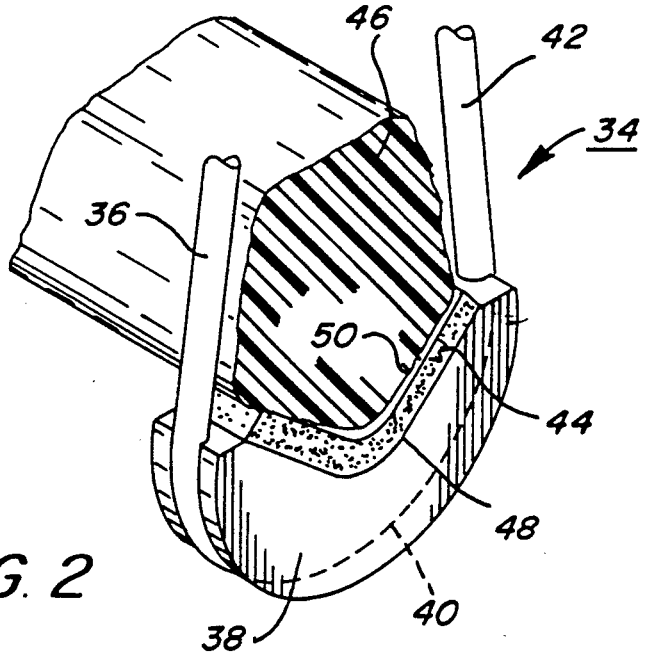
FIG. 2 is a fragmentary view of a string seat.

A large number of the longitudinal strings 26 in FIG. 1, preferably not less than one-third of the total number of longitudinal strings, are led toward the shank region 20. Some of such strings, especially those near the side of the frame, have to be inclined with respect to the longitudinal axis of the racket frame 12 in order to be channeled into the narrowing shank region. As shown in FIG. 2, a string 36 is wound around a string seat 38, preferably made from a hard material, smooth at its exposed surface 40, arranged in contact with the string and serving as a hub for the strings to be wound around. The other end 42 of the string is led back toward the string network 24. The string seat is pressed against a pad 44 of damping material sandwiched between the string seat 38 and a string post 46 which is a part of the frame at the shank region 20. Adhesive material may be applied at interface surfaces 48, 50 between the string seat 38 and pad 44, and the pad 44 and the post 46, respectively.

Figure 3:
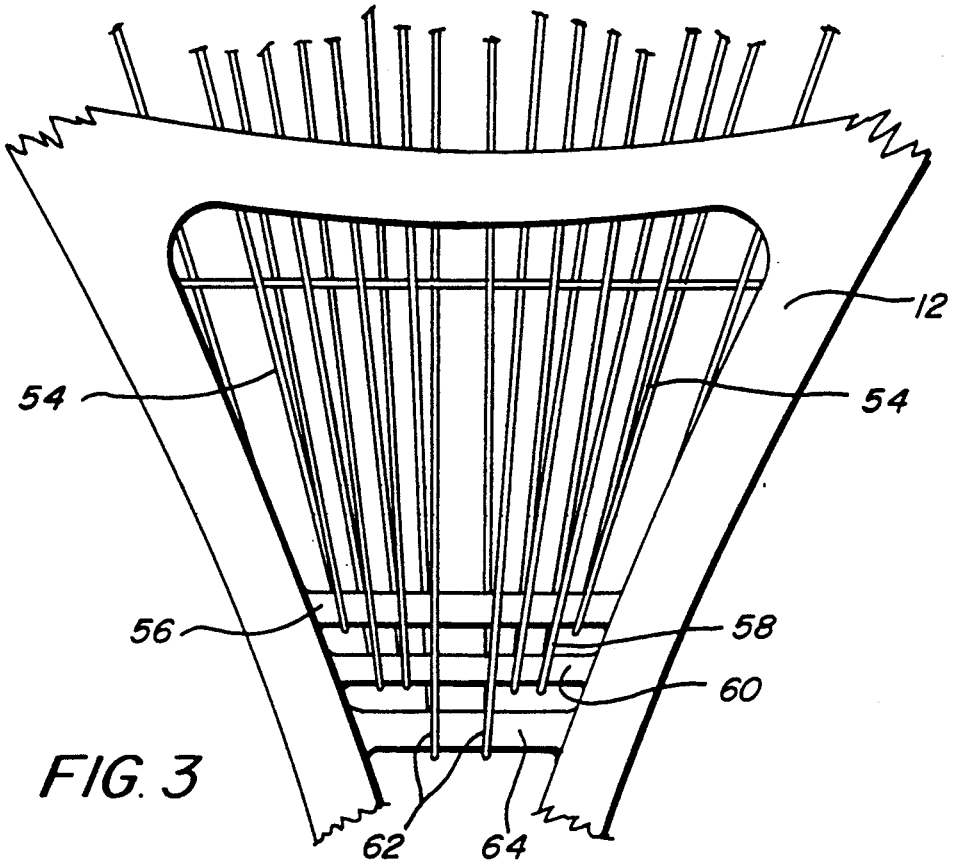
FIG. 3 shows a large number of longitudinal strings which are anchored separately on several string posts.

In another embodiment, as shown in FIG. 3, those longitudinal strings wound around the string post 46 in the embodiment of FIG. 2 are wound around several such posts in order to reduce the pressure to the damping material, hence improving the damping efficiency. A side string 54 is wound around a side string post 56, intermediate strings 58 are wound around an intermediate string post 60, and the central strings 62 are wound around the central string post 64. The diameters of the string posts may be varied so as to accommodate suitable elevations of the strings. For example, the diameter of string post 64 may be larger than the post 60 which is larger than post 56.

Since most damping materials are viscoplastic in nature, the optimum loading which can be put on the damping layer is relatively low. For example, with the C-1002 material of CABOT CORP., it is recommended that 100 psi (7.0 kg/cm) be the high end of the optimum preloading for best damping performance. If there are 12 central longitudinal strings to be anchored at the string post, with, for example, 50 lbs. (22.7 kg) each as string tension, the total force acting at the post is 600 lbs. (272 kg). If the damping pad has an area of 1.5 square inches (9.6 cm ), the pressure will be 400 psi (28 kg/cm). This pressure may be too high for an optimum application. Another preferred embodiment, then, is having several string posts, as shown in FIG. 3, where 16 strings may be anchored at three parallel string posts clustered closely in the shank region.

What is claimed is:

1. In a sports racket having a frame defined by a top section, two opposed side portions, a throat or shank section and a handle, the improvement comprising:

a string network having longitudinal strings and transverse cross strings wherein the axes of a portion of said longitudinal strings converge to a point within the handle, a string seating member secured to the frame adjacent the throat section, said portion of longitudinal strings being arranged to extend from the top section of the frame to and around said seating member and back to the top section, a damping member positioned on said string seating member between said seating member and said portion of longitudinal strings where said portion of strings extend around said seating member for damping vibration induced upon said portion of strings upon impact thereon by a sports racket.

2. The sports racket defined in claim 1 wherein said portion of longitudinal strings comprises at least one-third of the total of said longitudinal strings.

3. The sports racket defined in claim 1 wherein said longitudinal strings have a higher tension applied thereto than said transverse strings.

4. The sports racket defined in claim 1 wherein said string seating member includes a seat post secured to the side portions across the throat section and a string contacting element positioned between said seat post and said portion of strings extending around said seating member.

5. The sports racket defined in claim 4 wherein said damping member is positioned between said seat post and said contacting element.

6. The sports racket defined in claim 5 wherein adhesive material is between said damping member and said seat post.

7. The sports racket defined in claim 6 wherein adhesive material is between said damping member and said contacting element.

8. The sports racket defined in claim 1 including at least a second string seating member secured to the frame adjacent the throat section for reversing some others of the longitudinal strings and a damping member positioned between said other strings and said second string member.

* * * * *